US007431473B2

(12) United States Patent
Wilson et al.

(10) Patent No.: US 7,431,473 B2
(45) **Date of Patent: *Oct. 7, 2008**

(54) LIGHTING FOR DETENTION FACILITY

(75) Inventors: Brad Wilson, Twin Lakes, WI (US); Tim Scharnagle, Antioch, IL (US)

(73) Assignee: Kenall Manufacturing Co., Gurnee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/985,548

(22) Filed: Nov. 15, 2007

(65) Prior Publication Data

US 2008/0068831 A1 Mar. 20, 2008

Related U.S. Application Data

(63) Continuation of application No. 11/250,672, filed on Oct. 14, 2005, now Pat. No. 7,325,939.

(51) Int. Cl.
*F21S 8/00* (2006.01)

(52) U.S. Cl. ..... 362/147; 362/368

(58) Field of Classification Search ..... 362/145–150, 362/362, 364–365, 368, 370, 374–375, 432, 362/455

See application file for complete search history.

(56) References Cited

U.S. PATENT DOCUMENTS 4,453,202 A 6/1984 Morris et al.
5,794,397 A 8/1998 Ludwig
5,907,218 A 5/1999 Altman et al.
6,042,251 A 3/2000 McCarthy et al.
6,224,241 B1 5/2001 Oswald
6,241,368 B1 6/2001 Depino
6,467,928 B2 10/2002 Crelin
6,813,864 B2 11/2004 Landis

OTHER PUBLICATIONS

Pecora Corporation, Dynapoxy™ EP-1100 1:1 Epoxy Adhesive/ Sealant Specification Data Sheet. 2 pages, undated. <http://www.pecora.com/downloads/specdata/PecoraDynapoxyEP1100.pdf>.

*Primary Examiner*—Sandra O'Shea
*Assistant Examiner*—Jason Moon Han
(74) *Attorney, Agent, or Firm*—Jansson Shupe & Munger Ltd.

(57) ABSTRACT

A detention facility lighting fixture includes an elongate unibody housing having a flat back wall, four sidewalls including symmetrically sloped and opposed lengthwise sidewalls and trapezoidally shaped end sidewalls, at least one top wall, and welded seams at each of four corners, a door having a lens frame, a lens, and at least two Z-channels securing the lens to the lens frame, and a hinge secured to the housing, where the door and housing are adapted so that the top surface of the door, when closed, is essentially flush with the at least one top wall. A method includes providing a lighting fixture having a unibody housing with a flat back portion and beveled sidewalls, the housing being structured to receive a lens-holding door, and sealing a perimeter of the lighting fixture to the wall or ceiling with a continuous bead of security caulk.

14 Claims, 5 Drawing Sheets

LIGHTING FOR DETENTION FACILITY

RELATED APPLICATION

This application is a continuation of U.S. application Ser. No. 11/250,672 filed on Oct. 14, 2005 now U.S. Pat. No. 7,325,939, the contents of which are incorporated by reference herein in its entirety.

FIELD OF THE INVENTION

The invention is addressed to a fluorescent detention facility lighting fixture and, more particularly, to a detention facility lighting fixture optimized for elimination of concealment of contraband.

BACKGROUND OF THE INVENTION

Detention facilities are a part of a civilized society where persons are housed in a manner where personal freedoms are heavily restricted. Prisoners may include both well-behaved and unruly persons, some of whom may at times be inclined to be violent, to vandalize, or to hide personal items within the detention facility. Accordingly, it is desirable for the various fixtures within a detention facility to be designed in a manner that minimizes physical damage resulting from violence or vandalism and that prevents or greatly reduces any "hiding places" in or adjacent to such fixtures. In addition, heavy duty construction of fixtures provides a longer fixture life.

Early designs of metal lighting fixtures include structures that essentially are in the shape of a box and that have a hinged door. Such fixtures are known in the industry as "shoeboxes," and have been manufactured for the prison industry using heavy gauge materials and security type fasteners.

An improved style of detention facility lighting fixture is known in the industry as a "clamshell," which combines together the door and sidewalls of the fixture in a manner whereby the sides and front of the fixture are hinged together from one edge of one side. This moving portion is attached to a pan that is ceiling or wall mounted. The pan has a cavity in its backside, which is intended to be a trap for contraband that prisoners would try to hide. Although such fixtures became popular, they have several problems. For example, wall or ceiling surfaces in prison cells are often not flat. When the pans of clamshell fixtures are mounted on such walls or ceilings, they conform to the uneven surface and make it difficult to precisely mate the clam housing with the pan, and a resultant structure is often not properly flush and even. In addition, the pan of a clamshell fixture typically has a vertical leg that may allow a prisoner to conceal contraband by pushing the contraband a distance less than completely behind the fixture so that such contraband rests on the vertical leg. Additional problems are created by use of various conventional lighting fixtures.

OBJECTS OF THE INVENTION

It is an object of the invention to provide an improved apparatus and method overcoming some of the problems and shortcomings of the prior art, including those referred to above.

Another object of the invention is to provide apparatus and methods that eliminate hiding places in or around detention lighting fixtures.

Another object of the invention is to provide a tamper-proof sealing of a detention facility lighting fixture to a mounting surface.

How these and other objects are accomplished will become apparent from the following descriptions and associated drawing figures.

SUMMARY OF THE INVENTION

As will be apparent, the term "top" as used in this document (e.g., in "top wall" and "top surface") also referred to as "front wall" or "front surface" refers to the light fixture in an unmounted orientation as shown in FIGS. 1, 5 and 6, i.e., a position as if resting on a workbench.

As used herein with reference to the fixture housing, the term "unibody" refers to a structure formed from a single piece of raw material.

According to an aspect of the invention, a detention facility lighting fixture includes an elongate unibody housing having a flat back wall, four sidewalls including sloped and opposed lengthwise sidewalls and trapezoidally shaped end sidewalls, at least one top wall also referred to as a front wall, and welded seams at each of four corners, a door having a lens frame, a lens, and at least two Z-channels securing the lens to the lens frame, the door having a top surface, also referred to as an outside surface, and a hinge secured to the housing and the door so that the door may be swung between an open and closed position, where the door and housing are adapted so that the top surface/outside surface of the door, when closed, is essentially flush with the at least one top wall/front wall.

According to another aspect of the invention, a method of providing lighting in a cell of a detention facility includes providing an elongate unibody housing having a flat back wall, four sidewalls including symmetrically sloped and opposed lengthwise sidewalls and trapezoidally shaped end sidewalls, at least one top wall, and welded seams at each of four corners, providing a door having a lens frame, a lens, and at least two Z-channels securing the lens to the lens frame, the door having a top surface, providing a hinge secured to the housing and the door so that the door may be swung between an open and closed position, and sealing a perimeter of the housing adjacent the back wall to a detention facility mounting surface in a continuous bead of security caulk, where the door and housing are adapted so that the top surface of the door, when closed, is essentially flush with the at least one top wall.

According to a further aspect of the invention, a method of providing lighting in a cell of a detention facility, the cell having a wall or ceiling, includes providing a lighting fixture having a unibody housing with a flat back portion and beveled sidewalls, the housing being structured to receive a lens-holding door, and sealing a perimeter of the lighting fixture to the wall or ceiling with a continuous bead of security caulk.

According to another aspect of the invention, a detention facility lighting fixture includes an elongate unibody housing having a flat back wall, four sidewalls including sloped opposed lengthwise sidewalls and trapezoidally shaped end sidewalls, and at least one top wall, a door having a lens frame, a lens, and at least two rigid brackets securing the lens to the lens frame, the door having a top surface, and a hinge secured to the housing and the door so that the door may be swung between open and closed positions, the door and housing being adapted so that the top surface of the door, when closed, is essentially flush with the at least one top wall.

The present structural combination in a detention facility lighting fixture has sloped lengthwise sidewalls in a unitary housing and a door that, when closed, presents a face flush with such housing. As a result, the detention facility lighting fixture eliminates or greatly reduces any risk of physical damage (e.g., impact resistance and abrasion resistance) and any risk of concealment of contraband. Such a structure improves over conventional designs, which have not considered removing previous clamshell contraband traps from a backside mounting area and have not considered the present fabrication of metal in a way that is more costly and complex compared with traditional structures. The present combination may include a newly developed, high strength, hard, security caulk, which cannot be scraped or picked away and which prevents contraband from being stored behind the fixture. Conventional structures cannot be adequately installed consistently in precast prison cells that are formed with problems of maintaining dimensional stability. The combination of a sloped sided, unibody housing having a flat back wall with a highly viscous security caulk assures a secure seal of a detention facility lighting fixture with a mounting surface.

The foregoing summary does not limit the invention, which is defined by the attached claims. Similarly, neither the Title nor the Abstract is to be taken as limiting in any way the scope of the disclosed invention.

BRIEF DESCRIPTION OF THE DRAWING FIGURES

Figure 9A:
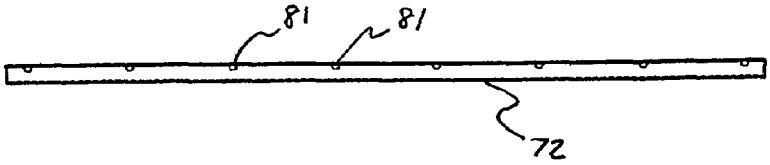
Figure 9B:
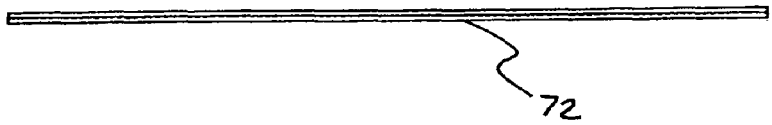
Figure 9C:
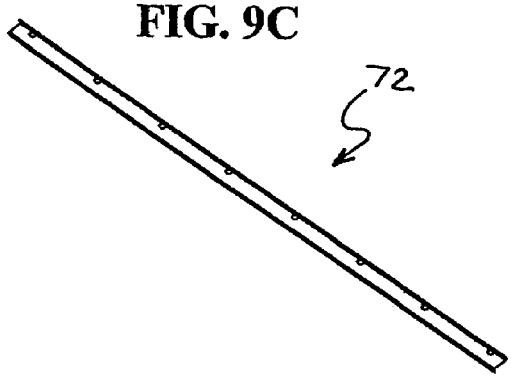

FIGS. 9A-9C respectively are top plan, front plan, and perspective views of a long Z-channel used for securing a lens assembly to a door of a detention facility lighting fixture, according to an exemplary embodiment of the invention.

Figure 10:
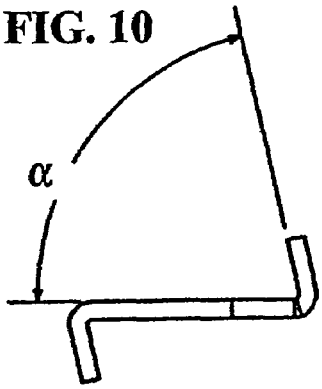

FIG. 10 is an end view of a Z-channel, representative of a profile for both long and short Z-channels, used for securing a lens assembly to a door of a detention facility lighting fixture, according to an exemplary embodiment of the invention.

Figure 11:
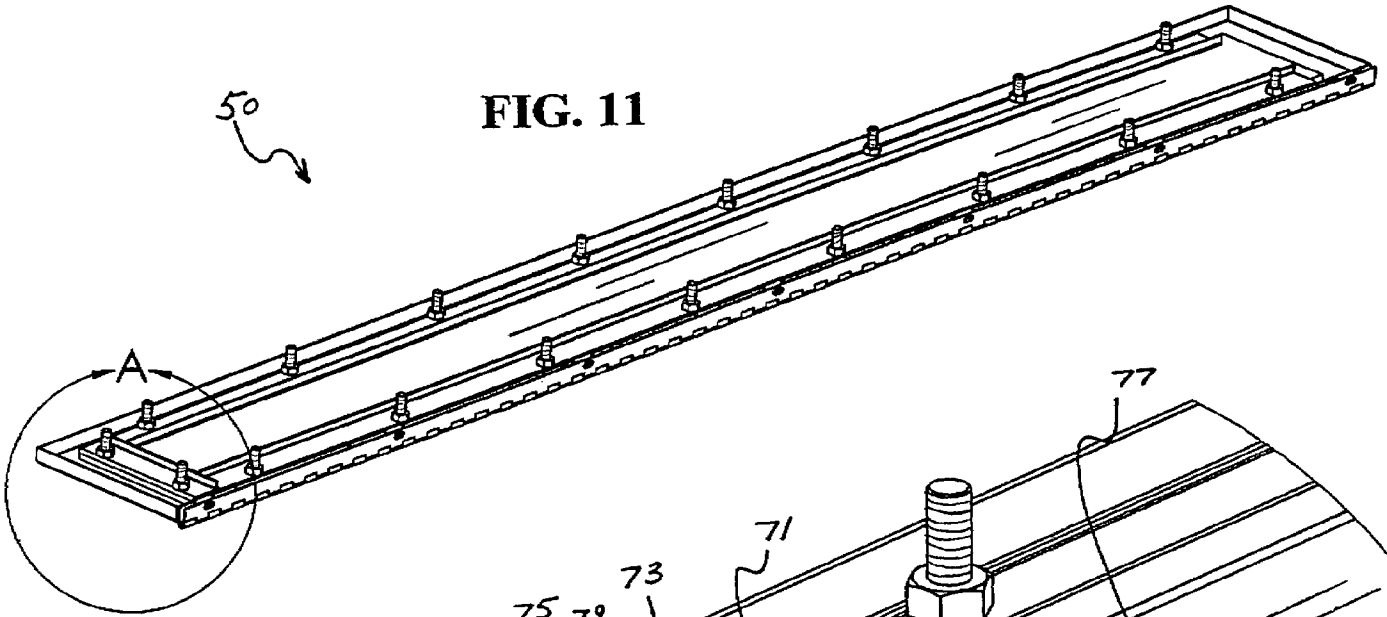

FIG. 11 is a perspective view of an assembled door of a detention facility lighting fixture, according to an exemplary embodiment of the invention.

Figure 12:
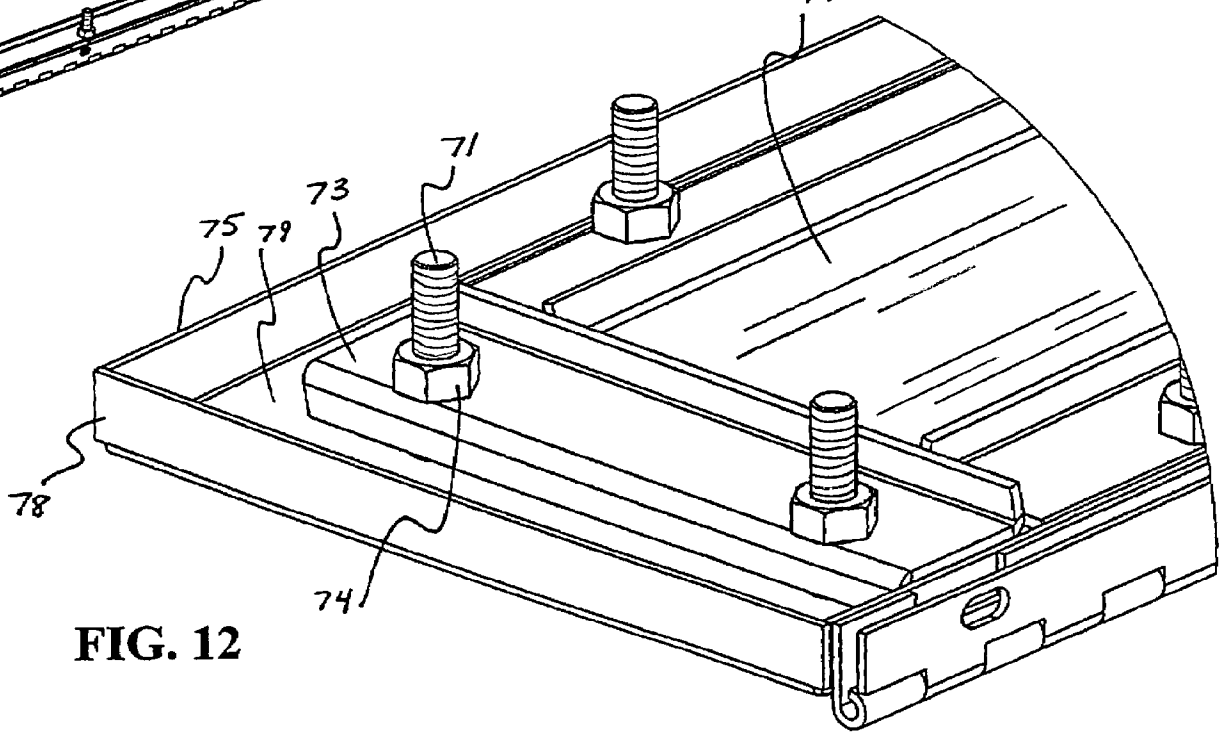

FIG. 12 is an enlarged view of a section of the door of FIG. 11, taken within the circle A-A, according to an exemplary embodiment of the invention.

DETAILED DESCRIPTION OF PREFERRED EMBODIMENTS

Figure 1:
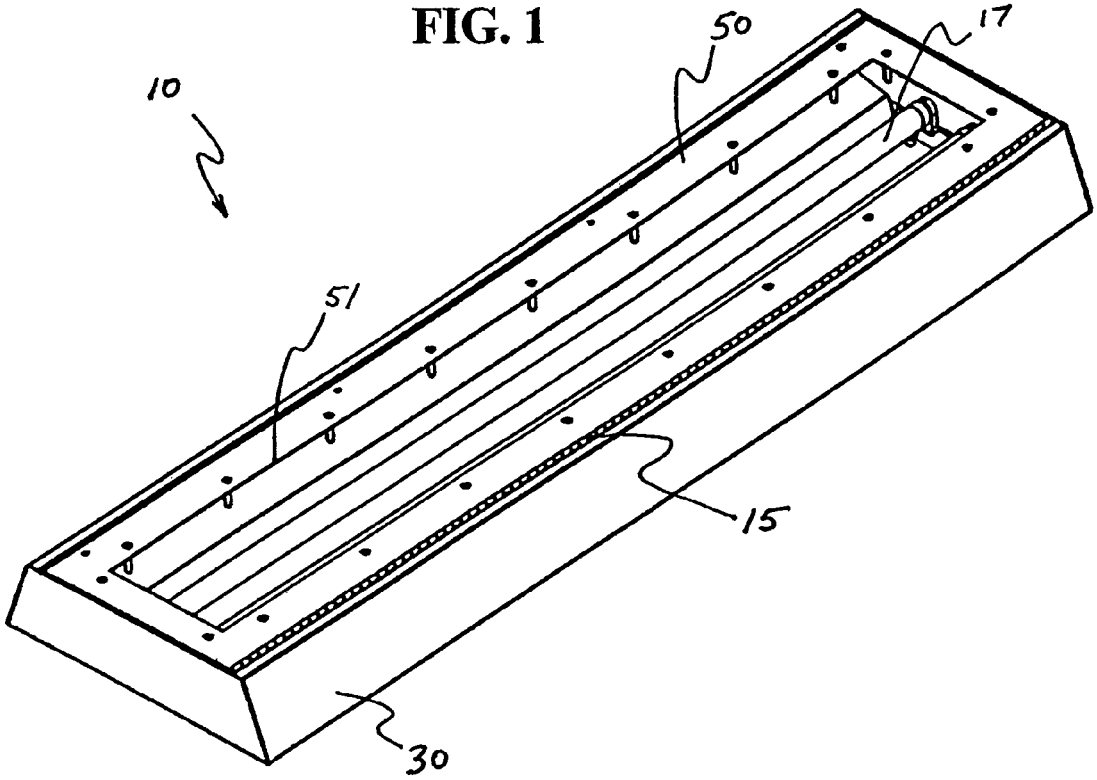
FIG. 1 is a perspective view of a detention facility lighting fixture, according to an exemplary embodiment of the invention.

FIG. 1 is a perspective view of a detention facility lighting fixture 10 according to an exemplary embodiment. Detention facility lighting fixture 10 is preferably formed of heavy gauge metal and includes a unibody housing 30, a door 50, and a hinge 15 secured to housing 30 and door 50 so that door 50 may be swung between an open and closed position. FIG. 1 shows door 50 in a closed position and having a clear lens so that some of the internal parts are visible, for illustration. A center open portion 51 is formed in door 50 and is covered by the lens. In practice, the lens is preferably a translucent structure that prevents viewing internal components of detention facility lighting fixture 10, and may be a multiple layer assembly. Door 50 and housing 30 are preferably each die formed in one piece of a prime grade sheet metal, of a heavy gauge such as 20 gauge or thicker. Corners are preferably formed to be continuously seam welded to be smooth without any post grinding, such as by TIG welding. Detention facility lighting fixture 10 thereby presents an exterior that is an exposed portion having a one-piece housing 30 and having a door 50 that closes to be a part of a unitary form by being recessed within the shape of housing 30. All exposed, both exterior and interior, surfaces of detention facility lighting fixture 10 are preferably finished using urethane powder coat and a five stage iron phosphate pre-treatment, thereby exceeding requirements of corrosion resistance and the like. Such finish materials are designed to provide a reflectance of approximately ninety-two percent, a gloss of eighty-five percent when measured at a sixty degree angle, a 2H hardness, and to meet a salt spray test of one thousand hours.

Figure 2:
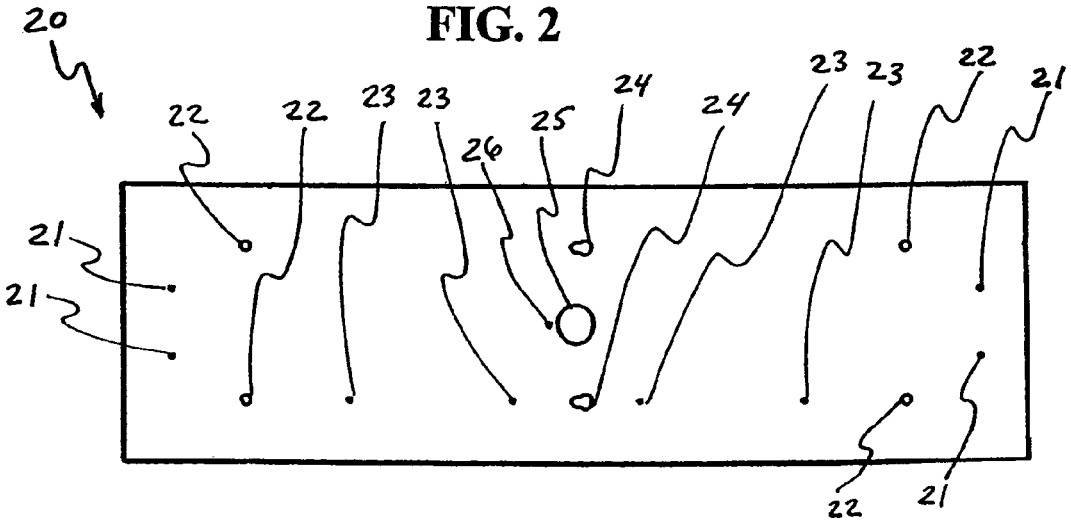
FIG. 2 is a bottom plan view of a bottom wall of the detention facility lighting fixture of FIG. 1, according to an exemplary embodiment of the invention.

Unibody housing 30 includes a flat back wall 20, shown by example in FIG. 2. Back wall 20 includes lamp socket bracket mounting posts 21 near each lengthwise end of housing 30, for mounting brackets that hold one or more fluorescent lamp sockets by fastening a nut (not shown) snugly against such bracket. Such mounting posts 21 are preferably threaded bolts that are permanently affixed to housing 30 by press-fitting so that the respective threaded portions extend orthogonally with respect to the plane of back wall 20, into the interior portion of housing 30. Similarly, ballast mounting posts 23 are provided by being press-fitted into flat back wall 20, for securing one or more ballasts to the interior of housing 30, and a grounding post 26 is provided for electrically grounding housing 30 in common with an electrical service ground. Each mounting bolt 21, 23, 26 is preferably a press-fit type bolt having a smooth flat outer head surface and ridges formed along the circumference of its respective head portion for engaging and securely holding the bolt in place, and corresponding bolt receptacles are formed in back wall 20 with respective diameters slightly less than the diameters of the bolts, which further improves the press fit. An electrical service hole 25 is provided for feeding electrical wires to the inside of housing 30, such as by use of conduit and the like. Keyhole mounting holes 24 are provided for ease of installing housing 30 against the mounting wall of a detention facility. For example, an installer may suspend housing 30 temporarily by inserting the heads of ceiling bolts (not shown) into keyholes 24 and then sliding housing 30 slightly until such ceiling bolts are engaged with the narrow portions of keyholes 24. The installer may then have an easier time installing ceiling fasteners in each of several mounting holes 22, and then snugly securing housing 30, such as with conventional nuts and bolts, so that back wall 20 is flush with and tight against such ceiling (or wall) surface. An installation template is preferably used for locating mounting holes on the mounting surface.

Figure 3:
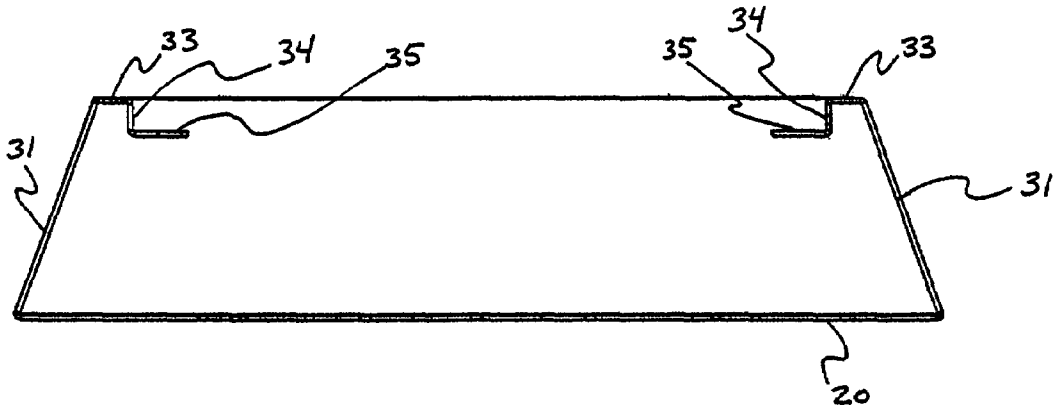
FIG. 3 is a cross section view of a housing of a detention facility lighting fixture, taken along the line A-A of FIG. 4, according to an exemplary embodiment of the invention.
Figure 4:
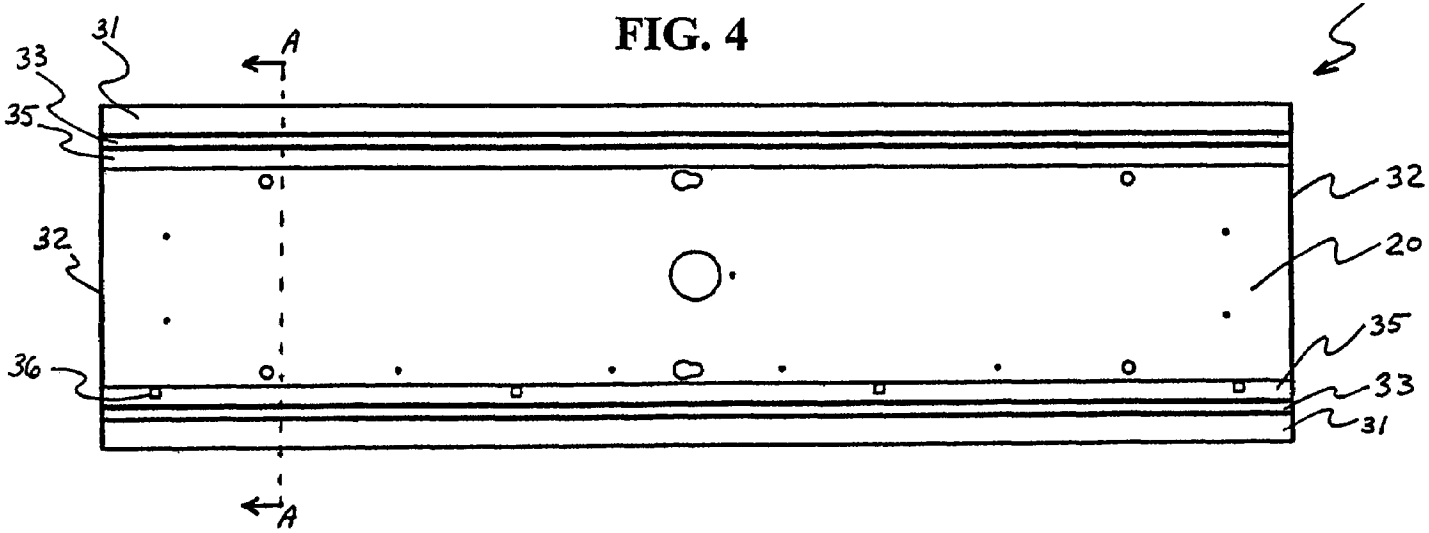
FIG. 4 is a top plan view of a housing of a detention facility lighting fixture, according to an exemplary embodiment of the invention.
Figure 5:
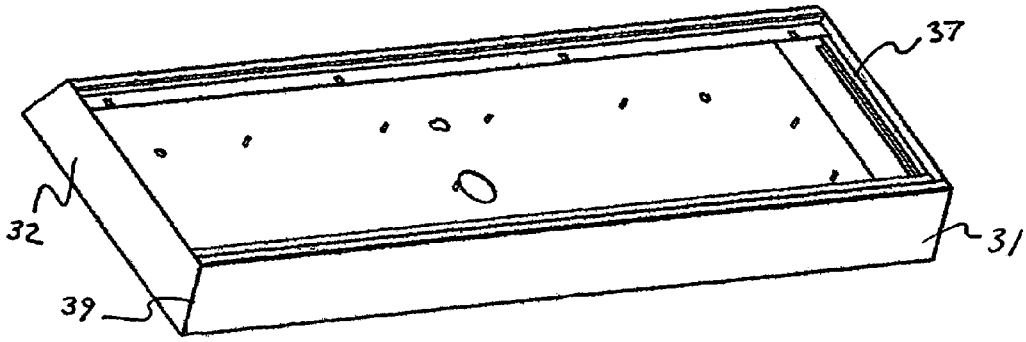
FIG. 5 is a perspective view of a housing of a detention facility lighting fixture, according to an exemplary embodiment of the invention.

FIG. 4 is a top view of housing 30 and FIG. 3 is a view taken along line A-A thereof. Two opposed sidewalls 31 extend the length of housing 30 and are bent to be symmetrically sloped inwardly between the back wall 20 and respective top walls 33. For example, an angle between back wall 20 and a sidewall 31 is shown as approximately one hundred ten degrees. Top walls 33 are preferably parallel to back wall 20, and extend a short distance inwardly from respective sidewalls 31. At such innermost points of top walls 33, a right angle bend is formed so that bridging portions 34 extend essentially orthogonally with respect to top walls 33 and bottom wall 20, for a distance approximating the width of a door 50. At such point, another right angle bend is formed to now create door stop walls 35 (also referred to as bulkheads) that extend inwardly. Accordingly, the profile shown in FIG. 4 extends the length of housing 30. One of the two door stop walls 35 has door fastener holes 36 adapted to receive inserts such as threaded receptacles that snap into such holes 36. Such inserts receive threaded tamper-proof bolts or the like for securing door 50, when closed, to housing 30. In addition, "C" brackets 37 are spot welded to respective end walls 32 at the lengthwise ends of housing 30, to provide door stop surfaces that are coplanar with door stop walls 35, as shown by example in FIG. 5. Alternatively, "L" brackets may be used as door stop surfaces along end walls 32. Each joinder of a sidewall 31 and an end wall 32 is preferably formed as a TIG weld 39 or the like.

Figure 6:
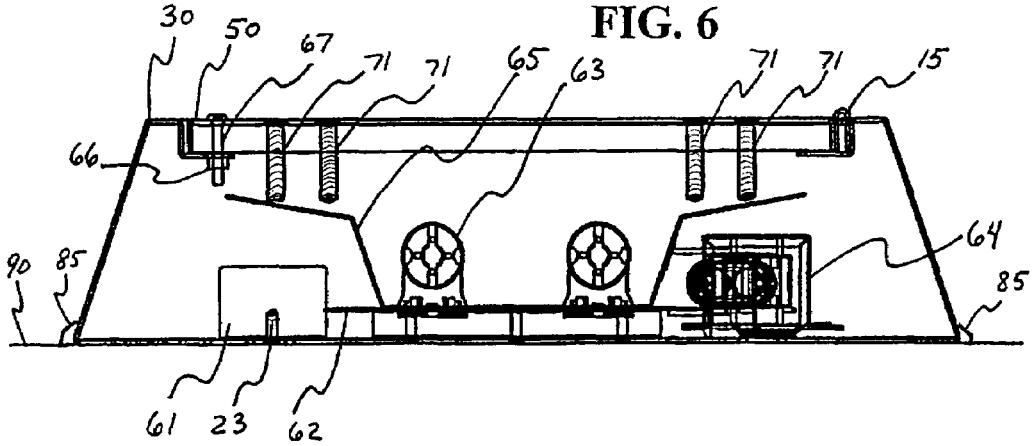
FIG. 6 is a cross section view of a detention facility lighting fixture, with some components removed for illustration purposes, according to an exemplary embodiment of the invention.

FIG. 6 is a cross sectional view of detention facility lighting fixture 10, shown for illustrative purposes without fluorescent tubes 17, Z-channels, and several other components. One or more ballasts 61 are secured to housing 30 using ballast mounting posts 23 and nuts (not shown). A mounting bracket 62 is secured at each lengthwise end to a pair of mounting posts 21, also using nuts or the like. One or more fluorescent lamp sockets 63 are attached to mounting bracket 62 such as by self-attachment structure that allows such sockets 63 to securely snap-in place. A reflector 65 extends most of the length of housing 30 and is attached at its ends to the corresponding mounting brackets 62, such as by using sheet metal screws (not shown) that secure reflector 65 by being fastened into holes supplied in mounting brackets 62. Rubber washers or O-rings (not shown) may be used with such sheet metal screws for preventing any buzzing or other movement of reflector 65. Various optional accessories may also be installed in housing 30 by forming housing 30 by press-fitting additional mounting posts into flat back wall 20, such accessories including, for example, a night light and switch assembly 64, and others. Door 50 is attached to housing 30 with hinge 15 and, when closed, door 50 may be secured in place using hardened tamper-proof door fasteners 67, which are fed through washers and holes in door 50 (not shown) and then tightened into threaded receptacles 66 that snap into door fastener holes 36. Although fasteners 67 are shown as protruding above door 50 and top walls 33, lens frame 70 may be formed with indentations and fasteners 67 may have low profile heads, so that fasteners 67 may be installed to be recessed to not protrude beyond a height of sidewalls 31 or end walls 32. Alternatively, door 50 may be recessed instead of being flush with top walls 33.

Figure 7:
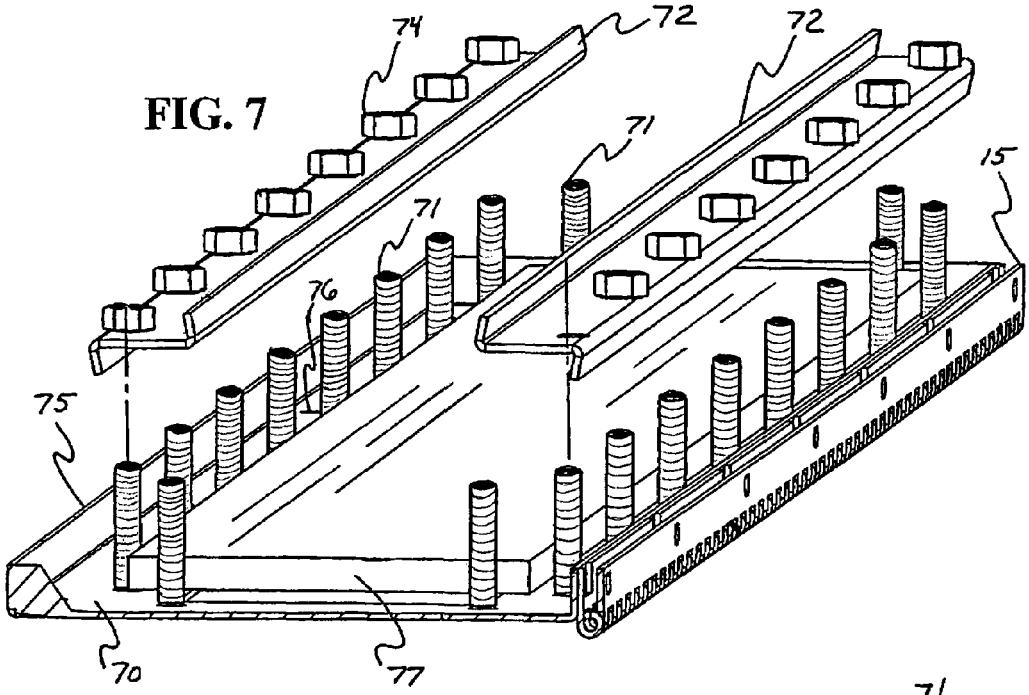
FIG. 7 is a cutaway, exploded, perspective view of a door of a detention facility lighting fixture, according to an exemplary embodiment of the invention.
Figure 8:
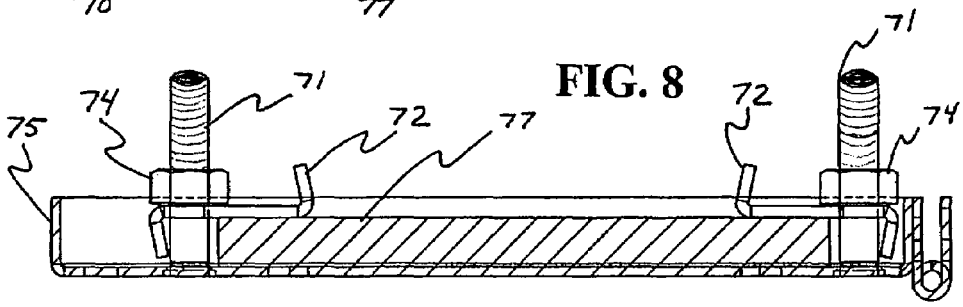
FIG. 8 is a cross sectional end view of a door of a detention facility lighting fixture, according to an exemplary embodiment of the invention.

FIG. 7 is an exploded perspective view showing a partial assembly of door 50 and its attachment to hinge 15, with a portion of door 50 removed for illustration purposes. FIG. 8 is a cross-sectional end view of an assembled door 50. A lens frame 70 is preferably a rectangular frame formed of a metal the same gauge as that of housing 30. Z-channel mounting bolts 71 are each press-fit into holes in lens frame 70 at locations around the center portion 51, the holes being slightly smaller than the diameter of bolts 71, so that a snug secure fit occurs between bolt 71 and lens frame 70. In addition, bolts 71 have ridges around their circumference to improve such fit. The heads of bolts 71 are preferably flush with an exterior of lens frame 70 after press-fitting.

A lens 77 is placed onto the inside surface of lens frame 70 and covers opening 51. A tempered prismatic glass (e.g., industry type C73) may be used as a one piece lens 77, where texture and/or prismatic structure is within the glass itself. Plexiglas or other suitable materials may alternatively be used. Although shown as a unitary structure, lens 77 may alternatively be a two or three piece structure, such as where an outer lens portion is a thick shatter-proof plexiglass or glass and an inner lens sheet is a patterned translucent plexiglass material that prevents a viewer from seeing the inside portion of detention facility lighting fixture 10. For example, a total luminaire efficiency over sixty-seven percent is typically achieved with a lens assembly 77 having an eighth inch prismatic acrylic inner lens and a three-eighths inch clear polycarbonate outer lens. Such a two piece lens may alternatively reverse the layer order of individual sheets. Although any of glass, acrylic, plexiglass, or similar materials may be used, glass may be required where heat is an issue. Where ultimate security is necessary, riot glass or similar materials having a mesh formed integrally may be used or, for example, a three-layer structure may include a glue-like, rubbery substance such as riot glass with a chemically-strengthened PVB interlayer that assures an extremely high strength glass lens. Lens 77 may be relatively thick (e.g., up to 0.625 inch or more).

A long Z-channel 72 has holes 81 that are spaced to be aligned with the bolts 71 along a lengthwise side of opening 51, so that the threaded portions of bolts 71 that extend from lens frame 70 may be passed through such holes 81. A same procedure and structure is used to attach a long Z-channel to bolts 71 along an opposite long side of opening 51. Nuts 74 are fastened onto bolts 71 and tightened so that lens 77 is held against the inside surface of lens frame 70 by long Z-channels 72. Long Z-channels 72 are shown in respective top, side, and perspective views of FIGS. 9A-9C, and an end elevation view of a Z-channel is shown in FIG. 10. The profile of FIG. 10 is the same for a short Z-channel 73, used for securing each lengthwise end of lens 77 to lens frame 70. In FIG. 10, an angle $\alpha$, for example, may preferably be approximately seventy-eight degrees. Hinge 15 is preferably a piano type hinge, for example having a half inch knuckle and an eighth inch pin secured to the knuckle. Hinge 15 in a preferred embodiment is welded to door 50 and fastened to housing 30 using sheet metal screws (not shown).

FIGS. 10 and 11 respectively show a perspective view of the interior portion of an assembled door 50 and an enlarged section thereof within a circular portion "A." A short Z-channel 73 has a profile as shown in FIG. 10, which includes holes spaced apart from one another a same distance as the spacing between bolts 71 located at lengthwise ends of door 50. Short Z-channel 73 is placed over such bolts and is snugly secured against lens 77 by tightening of nuts 74. Although FIG. 11 only shows a short Z-channel at one lengthwise end of door 50, a preferred configuration includes short Z-channels securing lens 77 at each lengthwise end of door 50. Lens frame 70 preferably has an interior surface 79 for mounting lens 77 thereto using Z-channels 72, 73, as well as lengthwise side walls 75 and end walls 78 which form a continuous edge around the circumference of lens frame 70. The seams between each joinder of a side wall 75 and an end wall 78 are preferably formed by welding or the like.

The detention facility lighting fixture of the present invention combines the best features of conventional shoebox and clamshell designs. The unitary housing eliminates contraband hiding places within a lighting fixture and also provides a flat back wall and associated flat perimeter edge between the back wall and four side walls, so that a mounting surface such as a ceiling or wall may be consistently sealed to such perimeter edge. In a novel aspect of the invention, a security caulk is provided in combination with detention facility lighting fixture 10, whereby a tamper resistant seal may be formed between detention facility lighting fixture 10 and the mounting surface. For example, a security caulk may be a two-part, non-sag, chemically curing epoxy adhesive/sealant having a part number EP-1100, available from Pecora Corporation of Harleysville, Pa. Such a security caulk was not able to be used reliably with conventional clamshell type lighting fixtures due to the aforementioned problems with a mounting pan fit. The newly created features of recently available security caulks such as the model EP-1100 include high compressive strength and hardness, exceptional bonding capabilities, long life, and ease of application due to a viscosity having a heavy paste quality. Such security caulk contains polyamide resin and epoxy resin, although any caulk having similar viscosity and resistance to picking/hardness may alternatively be used. A bead of security caulk 85 is shown in FIG. 6 forming a seal with a mounting surface 90, around a perimeter of detention facility lighting fixture 10.

An installer of detention facility lighting fixture 10 prepares such for installation by removing door fasteners 67 and reflector 65, and installing bolts (not shown) in a ceiling or wall mounting location for subsequent insertion of such bolts into keyholes 24. The installer should also install concrete screw receptacles or the like at locations on the mounting surface that correspond with locations of mounting holes 22. The locations for mounting holes 22, 24 are dictated by the location of an electrical service conduit to be secured to electrical service hole 25, so an installation template should be centered at such hole 25. Detention facility lighting fixture 10 is then lifted to a position where the aforementioned bolts are inserted into the large openings of keyholes 24, whereupon the fixture 10 is slid laterally to engage the bolts with the smaller sections of keyholes 24. At this position, the concrete screw receptacles should be aligned with holes 22, and bolts or screws are then installed in holes 22 and tightened to secure fixture 10 against the mounting surface. An electrical conduit nut (not shown) is then installed to secure the electrical feed at hole 25. Electrical wiring is then attached to wires feeding ballasts 61 and night light/switch assembly 64, and electrical ground is secured to grounding post 26. Reflector 65 is then secured in place with sheet metal screws and optional washers or O-rings, and fluorescent lamps are installed into lamp sockets 63. An operational check is now performed to assure that the fluorescent tubes are illuminated when power is applied. When proper operation is determined, door 50 is fastened into its closed position against housing 30 by installing and tightening tamper-proof door fasteners 67. Next, the installer places a continuous bead of security caulk 85 around the perimeter of detention facility lighting fixture 10 at the junction between sidewalls 31, back wall 20, and the mounting surface. The continuous bead is then preferably made uniform by use of a smoothing or forming tool, or the like. Alternatively, a caulking applicator may perform the dispensing and smoothing of the continuous bead of security caulk 85 in a single application step.

In various embodiments, a hinge may be replaced by a use of aircraft type cable (not shown) or the like for attaching a door to the housing. While such an unhinged arrangement may present logistical issues when there is a need to perform maintenance such as replacement of fluorescent lamps, the elimination of a hinge may provide advantages related to weight and cost savings, different security strategies, etc. A detention facility lighting fixture may alternatively use light emitting diode (LED) type lamps, which may require less maintenance and which may be implemented with or without a hinge being used for accessing an interior portion. Another embodiment of the invention includes sloping the end walls in a manner similar to that described above for sidewalls 31, so that a detention facility lighting fixture has a pyramid type shape. It is noted that the sloping of side and end walls has a security advantage in that such makes the detention facility lighting fixture more resistant to dents and other damage caused by blows with blunt objects, and may add structural integrity. In a further embodiment, end walls may be a same length as sidewalls, whereby a square detention facility lighting fixture is implemented. Such a structure may be appropriate depending on the sizes and shapes of lamps to be used.

An exemplary nominal size may have a length of one, two, or four feet and a width of one foot. Alternatively, a square housing may be used. The housing and door material is preferably between twelve and sixteen gauge, cold rolled steel or stainless steel with a brushed or painted finish. Lamp and ballast type can vary and still be in compliance with government regulations. For example, ballast(s) may be cold weather, electronic dimming, magnetic dimming, electronic with less than twenty percent THD, electronic with less than ten percent THD, standard magnetic, or other specified configuration. Ballasts may be of a chosen voltage and capacity. Accessories within the detention facility lighting fixture may include an emergency battery pack, such as a battery pack adapted for powering one lamp at 600 lumens for ninety minutes, a fuse and fuseholder, a radio interference filter, a speaker housing or extension, a night light, an ultraviolet filter, additional sealing or structure for wet locations, removable tray(s), switches, and others.

While the principles of the invention have been shown and described in connection with specific embodiments, it is to be understood that such embodiments are by way of example and are not limiting. Consequently, variations and modifications commensurate with the above teachings, and with the skill and knowledge of the relevant art, are within the scope of the present invention. The embodiments described herein are intended to illustrate best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

The invention claimed is:

1. A detention-facility lighting fixture for surface mounting on a ceiling-or-wall surface, comprising:

an elongate unitary housing having a back wall, a front wall spaced from the back wall, and four sidewalls, including opposed lengthwise sidewalls that are sloped inwardly toward the front wall, and opposed trapezoidal end sidewalls, the back wall having edge-adjacent portions for flush mounting on the surface of the detention facility;

a door having a lens frame with inside and outside surfaces, a lens, and at least two rigid brackets securing the lens to the inside surface of the lens frame; and a hinging device secured to the housing and the door so that the door may be swung between open and closed positions, the door and housing being adapted so that, when the door is closed, the outside surface thereof is essentially flush with the front wall of the housing.

2. The detention facility lighting fixture of claim 1 installed against a ceiling or other mounting surface and further comprising security caulk sealing a perimeter of the housing adjacent the back wall to a mounting surface.

3. The detention facility lighting fixture of claim 1 wherein the door has an inside surface and an outside surface, the door further comprising a plurality of studs each having a head face and a threaded shaft, the plurality of studs being secured to the door so that each head face is substantially flush with the outside surface of the door and so that the threaded shafts extend from the inside surface of the door, and wherein the rigid brackets are mounted to the plurality of studs for the securing of the lens to the lens frame.

4. The detention facility lighting fixture of claim 1 wherein the housing includes a single piece including a bend at a juncture of the back wall to each sloped lengthwise sidewall, a bend at a juncture of the back wall to each opposed trapezoidal end sidewall, a bend at a juncture of each sloped lengthwise sidewall and a respective front wall, and welding along the entire juncture of each sloped lengthwise sidewall with each opposed trapezoidal end sidewall.

5. The detention facility lighting fixture of claim 4 wherein each lengthwise portion of the housing includes a bend at a juncture of the front wall and a bridging portion essentially normal to the front wall and another bend at a juncture of the bridging portion and a lengthwise door stop wall essentially parallel to the front wall.

6. The detention facility lighting fixture of claim 5 further comprising a lateral door stop member secured to an inner surface of one of the opposed trapezoidal end sidewalls, the lateral door stop member having a surface coplanar with the lengthwise door stop wall.

7. The detention facility lighting fixture of claim 1 wherein the hinging device is mounted to an inward-facing surface of the housing so that a mounting location of the hinging device cannot be accessed when the door is in a closed position.

8. The detention facility lighting fixture of claim 1 wherein the sloped opposed lengthwise sidewalls are symmetrically sloped.

9. The detention facility lighting fixture of claim 1 wherein the rigid bracket is a Z-channel.

10. The detention facility lighting fixture of claim 1 wherein the housing is a unibody housing.

11. A method of providing lighting in a cell of a detention facility, the cell having a ceiling or other mounting surface, the method comprising:

providing a lighting fixture including a unitary housing with (a) a back portion for mounting on the surface of the detention facility and (b) beveled sidewalls, inclined toward a front wall, the housing being structured to receive a door having a lens frame with inside and outside surfaces, the door being hinged to the housing and the door and housing being adapted so that the outside surface of the door, when closed, is essentially flush with the front wall; and sealing a perimeter of the housing adjacent the back wall to the mounting surface by a continuous bead of security caulk.

12. The method of claim 11 further comprising providing the door, the housing having an end view profile and being structured to hold the door in a closed position so that the outside surface of the door does not extend outside the end view profile of the housing.

13. The method of claim 11 wherein the door is attached to the housing with a hinging device mounted to an inward-facing surface of the housing so that a mounting location of the hinging device cannot be accessed when the door is in a closed position.

14. A method of providing lighting in a cell of a detention facility, the cell having a mounting surface, the method comprising:

providing a lighting fixture including:

an elongate unitary housing having a back wall, a front wall spaced from the back wall, and four sidewalls, including opposed lengthwise sidewalls that are sloped inwardly toward the front wall, and opposed trapezoidal end sidewalls, the back wall having edge-adjacent portions for flush mounting on the surface of the detention facility;

a door having inside and outside surfaces and a lens frame with inside and outside surfaces, a lens, and at least two rigid brackets securing the lens to the inside surface of the lens frame, and a hinging device secured to the housing and the door so that the door may be swung between open and closed positions, the door and housing being adapted so that the outside surface of the door, when closed, is essentially flush with the front wall; and sealing a perimeter of the housing adjacent the back wall to the mounting surface by a continuous bead of security caulk.

* * * * *